US006871632B2

(12) United States Patent
Henn et al.

(10) Patent No.: US 6,871,632 B2
(45) Date of Patent: Mar. 29, 2005

(54) METHOD FOR REGULATING THE FUEL INJECTION OF AN INTERNAL COMBUSTION ENGINE

(75) Inventors: Michael Henn, Lehre (DE); Hong Zhang, Tegernheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/440,929

(22) Filed: May 19, 2003

(65) Prior Publication Data

US 2003/0221669 A1 Dec. 4, 2003

(30) Foreign Application Priority Data

May 31, 2002 (DE) ..... 102 24 213

(51) Int. Cl.[7] ..... F02D 1/00
(52) U.S. Cl. ..... 123/399; 123/345
(58) Field of Search ..... 123/399, 395, 123/345, 346, 347, 348, 376

(56) References Cited

U.S. PATENT DOCUMENTS 6,219,611 B1 * 4/2001 Russell ..... 701/105
6,250,283 B1 * 6/2001 Russell et al. ..... 123/361
6,357,403 B1 * 3/2002 Yano ..... 123/90.11
6,390,063 B1 * 5/2002 Obata et al. ..... 123/399
6,497,212 B2 * 12/2002 Matsumoto et al. ..... 123/295
6,502,546 B2 * 1/2003 Kawasaki et al. ..... 123/399
6,520,148 B2 * 2/2003 Yonezawa et al. ..... 123/399
6,553,964 B2 * 4/2003 Arai et al. ..... 123/399
6,675,768 B2 * 1/2004 Kanai ..... 123/336
6,732,707 B2 * 5/2004 Kidokoro et al. ..... 123/396

* cited by examiner

*Primary Examiner*—John T. Kwon
(74) *Attorney, Agent, or Firm*—Richard A. Speer; Mayer, Brown, Rowe & Maw, LLP

(57) ABSTRACT

A method is described for regulating the fuel injection of an internal combustion engine, to which combustion air is fed through an intake tract, in which two final control elements which are connected in series in the intake tract and in each case control the air mass flow through the intake tract are controlled in respect of their position, an air mass flow (MF) into the intake tract and also an induction manifold pressure (P) prevailing in the intake tract between the final control elements are measured and measurement values are formed in the process, the actual position of both final control elements and the actual rotational speed of the internal combustion engine are sensed and model values for air mass flow (MF) and induction manifold pressure (P) are determined therefrom in an invertible numeric model and an alignment of the model is effected by means of the measurement values and model values, and desired positions for the two final control elements are ascertained from desired values for the air mass flow (MF) and the induction manifold pressure (P) by using a model inverted with respect to the aligned model, and the final control elements are set to the desired positions.

6 Claims, 3 Drawing Sheets

METHOD FOR REGULATING THE FUEL INJECTION OF AN INTERNAL COMBUSTION ENGINE

BACKGROUND OF THE INVENTION

The invention relates to a method for regulating the fuel injection in an internal combustion engine, to which combustion air is fed through an intake tract, in which two final control elements which are connected in series in the intake tract and in each case control the air mass flow through the intake tract are controlled in respect of their position, whereby an air mass flow into the intake tract and also an induction manifold pressure prevailing in the intake tract are measured and measurement values are formed in the process.

In particular in the case of an internal combustion engine having external fuel/air mixing a method is known for controlling the combustion air mass flow and thus the fuel injection in the combustion chambers of the internal combustion engine by way of a final control element provided in the intake tract. Normally this final control element takes the form of a throttle valve which can be used to stop the cross-section of the intake tract. The position of the throttle valve then has a direct effect on the fuel injection. If the throttle valve is not fully open, then the air drawn in by the internal combustion engine is throttled and the torque delivered by the internal combustion engine is thus reduced. This throttle effect depends on the position and thus on the cross-section of opening of the throttle valve. When the throttle valve is fully open, the maximum torque is delivered by the internal combustion engine.

In order to achieve optimum control of the throttle valve, the latter is actuated by an actuator with position feedback. In this situation, a control unit is provided which calculates the required opening for the throttle valve by taking into consideration the current operational state of the internal combustion engine and controls the throttle valve actuator. To this end, an accelerator pedal position is evaluated by way of a pedal sensor.

During operation of the internal combustion engine, particular importance is attached to the determination of the air mass flowing into the cylinders of the internal combustion engine. EP 0 820 559 B1 proposes a model-based method in this respect, in which a variable which is characteristic of the fuel injection, namely the air mass flow or the induction manifold pressure, is measured and used in a model structure for more precise determination of the fuel injection. As a result, it is possible to exactly implement a desired fuel injection, which has been calculated from a requested torque for example, by means of a corresponding throttle valve setting.

In order to keep the losses occurring at the throttle valve as small as possible, a method is known whereby inlet valves of an internal combustion engine are capable of being operated with variable valve lift. The inlet valves then open with a settable valve lift such that it is possible to dispense with the actuation of the throttle valve at least in certain operational phases of the internal combustion engine. The fuel injection for the internal combustion engine is then controlled exclusively by way of the setting for the valve lift.

Both in order to obtain the lowest possible fuel consumption and in order to achieve a transition which is as imperceptible as possible and thus convenient between fully unthrottled operation, in other words operation of the internal combustion engine with fuel injection regulated exclusively by way of the valve lift adjustment, and conventional operation, the aim is to achieve as smooth a transition as possible with overlapping effects of valve lift control and throttle valve control.

The object of the invention is therefore to set down a method for regulating fuel injection in an internal combustion engine in which two final control elements which are connected in series in the intake tract and in each case control the air mass flow through the intake tract are coordinated with one another and can be used for regulating fuel injection.

BRIEF DESCRIPTION OF THE INVENTION

This object is achieved according to the invention by a method for regulating the fuel injection in an internal combustion engine, to which combustion air is fed through an intake tract, in which two final control elements which are connected in series in the intake tract and in each case control the air mass flow through the intake tract are controlled in respect of their position, an air mass flow into the intake tract and also an induction manifold pressure prevailing between the final control elements in the intake tract are measured and measurement values are formed in the process, the actual position of both final control elements and the actual rotational speed of the internal combustion engine are sensed and model values for air mass flow and induction manifold pressure are determined therefrom in an invertible numeric model and an alignment of the model is effected by means of the measurement values and model values, and desired positions for the two final control elements are ascertained from desired values for the air mass flow and the induction manifold pressure by using a model inverted with respect to the aligned model, and the final control elements are set to the desired positions.

According to the invention, the fuel injection characteristics of the internal combustion engine, in other words air mass flow and induction manifold pressure, are therefore mapped in a model. This model is then aligned by means of adaptation to the measured variables for air mass flow and induction manifold pressure. A forward path therefore comes about in which a precise calculation for the fuel injection is achieved by the model. In respect of high dynamic performance of the internal combustion engine in particular, the model guarantees an extremely good representation of the actual values. In this situation the alignment of the model, by means of a comparison of the measured values and the modeled values for example, also guarantees a high stationary precision for the fuel injection regulation.

Through the use of the inverted model, deviations between desired values and actual values in the case of air mass flow and induction manifold pressure are automatically compensated for in a reverse path by taking into consideration the equalization from the forward path.

On the basis of a model approach, by taking into consideration the measured values for air mass flow and induction manifold pressure when aligning the model, the concept according to the invention links the calculation of the actual values to the desired values. Since the link using model alignment guarantees stability for the system, which is inherently capable of oscillation, the control processes for the two final control elements can otherwise be implemented independently in corresponding control circuits.

The method according to the invention can be applied to any internal combustion engine having two final control elements in the intake tract which are connected in series and in each case control the air mass flow through the intake tract. As a rule in this situation these will be a throttle valve and a valve lift adjuster, the latter serving to influence the behavior of the inlet valves during the opening operation. In this situation, an adjustment of the inlet valve control times is conceivable in the same way as an adjustment in the maximum lift that the inlet valves can execute during the opening operation. In this situation, furthermore, only inlet valves which are capable of discontinuous adjustment are suitable for the method according to the invention, for example inlet valves which can be adjusted between two different maximum lifts.

The method according to the invention provides the basis for independent control facilities for the two final control elements, a throttle valve and a valve lift adjuster for example. In this way, a smooth transition can be achieved both in unthrottled operation, where for example the air mass flow of the combustion air takes place only by way of the valve lift adjuster, through to conventional throttled operation, where for example inlet valves are operated with maximum valve lift and the fuel injection is controlled by way of a throttle valve.

An inverted model is used in order to determine the desired positions of the two final control elements, in other words a model which has been obtained from an inversion of the particular model which was used for determining the model values for air mass flow and induction manifold pressure. In order to ensure that the previously performed model alignment has been taken into consideration with regard to the inverted model, in principle two different courses of action come into consideration:

On the one hand, after the alignment the model can be subjected to an inversion process. An extremely high level of numeric precision can be achieved by this means.

On the other hand, with regard to the alignment of the model, alignment parameters can be ascertained which are input into the model in a suitable manner and ensure an alignment. For example, multiplicative or additive correction factors may be involved. These alignment parameters are then likewise taken into consideration in a suitable manner with regard to an already previously inverted model. How they are then incorporated into the inverted model in this situation depends essentially on the model structure. Thus, for example, a multiplicative correction factor will as a rule be likewise included multiplicatively or in the form of a division in the case of the inverted model. However, it is also possible to use a further mathematical operation, by using a characteristic field for example, to obtain from the alignment parameters a new alignment parameter for the inverted model.

The use of a previously inverted model, in which alignment parameters originating from the alignment of the original, in other words non-inverted, model are included, has the advantage that the computation requirement is considerably reduced. Moreover, it also makes possible a development to the effect that new alignment parameters are only used in the inverted model when the internal combustion engine is within a certain operational parameter range.

For this embodiment, it is preferable that alignment parameters are saved and that new values for alignment parameters are only stored if the internal combustion engine is within a certain operational parameter range. With this embodiment, it is possible to achieve a situation whereby in operational phases exhibiting a high dynamic performance of the internal combustion engine the calculation of the desired positions for the two final control elements is carried out without renewed alignment. This means that an increase in precision can be achieved since during highly dynamic operational phases of the internal combustion engine sometimes the measurement values for air mass flow and induction manifold pressure sometimes do not match the actual values.

As a result of using the development according to the invention, the correction of the measurement values which is otherwise unavoidable in such cases can be dispensed with completely in the case of highly dynamic operational phases of the internal combustion engine, since such measurement values no longer play any part in regulation of fuel injection.

As soon as the internal combustion engine is then outside the particular operational parameter range, for example a dynamic range exists in which the measurement values very precisely reflect the actual values, the storage of alignment parameters and thus the alignment process itself are resumed.

In order to achieve a maximum degree of independence in the control of the two final control elements and to minimize the computation requirement it is advantageous to split the model into two sub-models. In a preferred development of the invention, provision is therefore made to use a first sub-model in which the model value for the air mass flow is calculated from the measurement value for the induction manifold pressure and from the actual position of the first final control element, and a second sub-model is used in which the model value for the induction manifold pressure is calculated from the measurement value for the air mass flow and from the actual position of the second final control element.

The separation into two sub-models is an option particularly in the case when one final control element acts on the induction manifold pressure and the other final control element acts on the air mass flow. This is the case when a throttle valve and also a valve lift adjuster are used. The two sub-models then act in each case on the individual control circuits of the final control elements such that a linkage of the control facilities then only occurs by way of the alignment.

In the case of two sub-models, it is advantageous to likewise carry out the alignment in two parts, whereby the result of the alignment of one sub-model can be directly taken into account for the other sub-model, resulting in increased precision. A development is therefore provided in which the first sub-model is aligned before the calculation is carried out in the second sub-model, whereby an alignment parameter is ascertained which is taken into account in the second sub-model.

BRIEF DESCRIPTION OF THE DRAWINGS

The invention will be described in detail in the following with reference to the attached drawings by way of example. In the drawings.

DETAILED DESCRIPTION OF THE INVENTION

Figure 1:
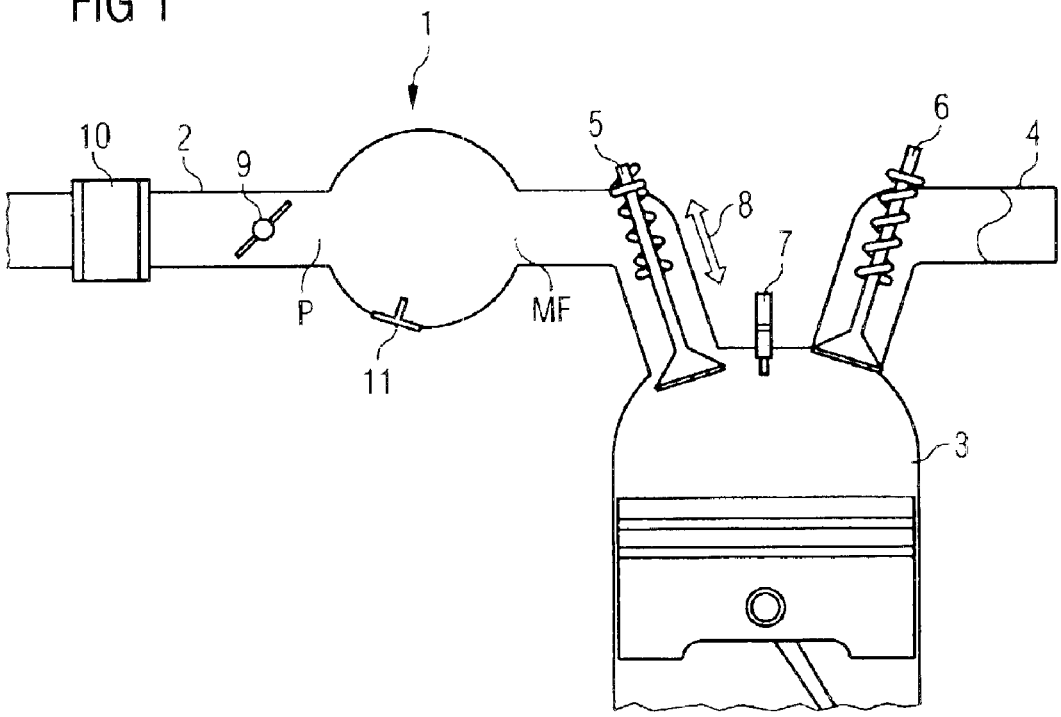
FIG. 1 shows a schematic representation of an intake tract of an internal combustion engine.

The internal combustion engine 1 is illustrated schematically in FIG. 1 with regard to its intake side. It has an intake tract 2, by way of which combustion air enters the combustion chambers of the internal combustion engine 1. A combustion chamber 3 is illustrated schematically in FIG. 1. Exhaust gases from the combustion flow into an exhaust gas tract 4. The combustion chamber 3 is closed off from the intake tract 2 by way of an inlet valve 5 and is closed off from the intake tract 4 by way of an outlet valve 6. In addition, a spark plug 7 projects into the combustion chamber, which ignites the fuel/air mixture that has been taken in and compressed.

The lift of the inlet valve 5 can be adjusted by way of a valve lift adjustment unit 8 which is indicated schematically in FIG. 1 by means of a double-ended arrow. In this situation the inlet valve 5, which is actuated by way of a camshaft drive (not shown), executes a maximum lift, differing in size according to the setting of the valve lift adjustment unit 8, which lies between a minimum and a maximum valve lift value. For the sake of simplicity reference is made here simply to "valve lift", by which is meant the maximum raising of the inlet valve 5 during an opening operation. The valve lift is sensed by a valve lift sensor (not shown in FIG. 1).

Also located in the intake tract 2 is a throttle valve 9 which is actuated by means of an actuator with position feedback. In order to implement position feedback a throttle valve sensor (not drawn in FIG. 1) is provided which delivers a measurement value for the opening angle of the throttle valve.

Upstream of the throttle valve 9 in the direction of flow, in the vicinity of the inlet to the intake tract 2, is located an air mass flow sensor 10 (air mass meter) which detects the air mass flow MF flowing through the intake tract 2. An air mass flow sensor 10 of this type is known for air mass controlled control systems for internal combustion engines.

In addition, between the throttle valve 9 and the inlet valve 5 is situated a pressure sensor 11 which measures the pressure at that point in the intake tract 2. Such a measurement of the induction manifold pressure P is likewise known in the case of induction manifold pressure controlled control concepts.

Figure 2:
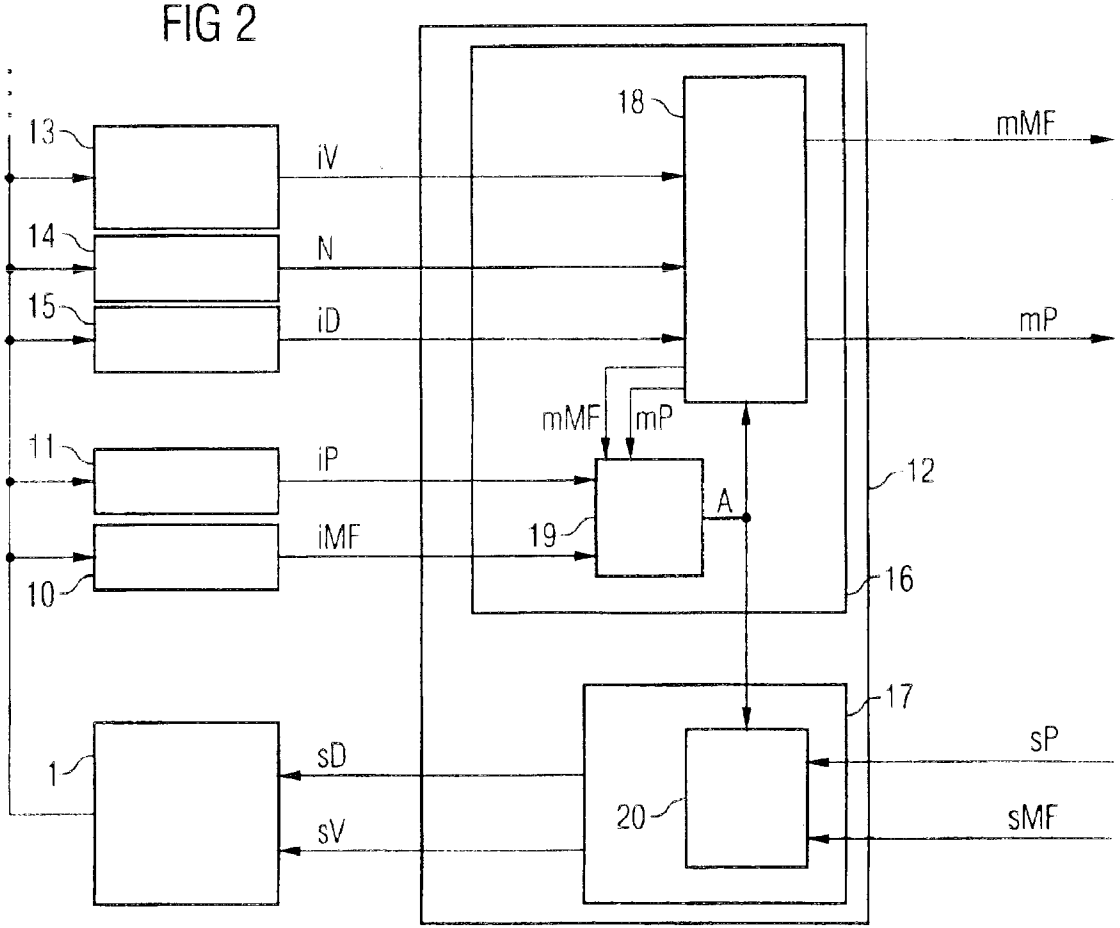
FIG. 2 shows a regulation structure for a first embodiment of a method for regulating fuel injection in the case of an internal combustion engine.

The block diagram shown in FIG. 2 illustrates the individual functions which are executed in order to implement a method for fuel injection regulation. In this situation, individual sensors and calculation blocks and also the variables transmitted between them are illustrated. Desired variables are prefixed with an "s", modeled variables are prefixed with an "m" and actual variables are prefixed with an "i" in order to facilitate corresponding differentiation.

In this situation, the method is executed by a control unit 12 which is supplied with measurement values relating to operational parameters of the internal combustion engine 1.

In the internal combustion engine 1 shown in schematic representation, the actual value for the air mass flow MF is sensed by way of the air mass flow sensor 10. The pressure sensor 11 measures the actual value of the induction manifold pressure P. The valve lift sensor 13 senses the actual value of the valve lift V, a rotational speed sensor 14 measures the rotational speed N and the throttle valve sensor 14 delivers at its output the actual value of the throttle setting D. The actual values for valve lift V and throttle setting D and also the rotational speed N are read in by the control unit 12.

The control unit 12 has a forward block 16 and also a reverse block 17. Modeled values for air mass flow MF and induction manifold pressure T are determined in the forward block 16. To this end, the forward block 16 has a model unit 18 and also an alignment module 19 whose function will be described below.

The model unit 18 receives the actual values for valve lift V and throttle setting D along with the measured value for rotational speed N, and uses these input variables to calculate model values for the induction manifold pressure P and the air mass flow mMF. In this situation, other input variable such as temperature in the intake tract 2 etc. can also be taken into consideration. In this situation, the following equation 1 serves as the basis in the model $$mMF=C\times Q\times LD\times PSI \qquad \text{(equation 1)}$$

in which C denotes a temperature-dependent constant, Q denotes a cross-section function of the throttle valve, LD denotes the ambient air pressure and PSI denotes a Psi function. The constant C represents the temperature influences on the gas flow rate and can either be taken from a suitable characteristic field or can be calculated by means of the following equation 2 from the gas constant G, the air temperature T and an the [sic] isotropic exponent K of the gas (where air is 1.4):

$$C=\sqrt{\frac{2K}{(K-1)}\frac{1}{GT}}, \qquad \text{(equation 2)}$$

The cross-section function Q defines the cross-section of flow released by the throttle valve 9 as a function of the throttle valve setting D, and is determined by reverting to a suitable characteristic.

The Psi function PSI represents a value depending on the pressure gradient across the throttle valve, in other words depending on the quotient formed from the induction manifold pressure P and the air pressure LD; in technical circles it is known to the person skilled in the art.

The modeled air mass flow mMF calculated in this way is output by the model unit 18 to, among other things, the alignment module 19.

In order to calculate the modeled induction manifold pressure mP, the model unit 18 assesses the mass flows in the intake tract according to the following equation 3

$$mP=\frac{G\cdot T}{V}\int(MF-MZ)dt \qquad \text{(equation 3)}$$

in which V denotes the intake tract volume between throttle valve and inlet valve and MZ denotes the air mass flow into the cylinder. In this situation, the air mass flow into the cylinder can be calculated by means of the following equation 4

$$MZ=VF\cdot(F1\cdot mP-F2) \qquad \text{(equation 4)}$$

in which VF represents a valve lift function, in other words the influence of the valve lift V on the air mass flow MZ flowing into the cylinder. The factors F1 and F2 are volume efficiency levels dependent on rotational speed and operational parameters, whereby F1 denotes the gradient of an efficiency level curve and F2 denotes its null value (offset).

The two equations 3 and 4 produce a differential equation from which the modeled induction manifold pressure mP can be calculated as a function of the air mass flow MF and also of the parameters which are input into the valve lift function VF and the factors F1 and F2.

By solving this differential equation, as is described in EP 0 820 559 B1 mentioned at the beginning for example, the model unit 18 determines the modeled induction manifold pressure mP and outputs this at the output to the alignment module 19.

The alignment module 19 now calculates alignment parameters A from the difference between modeled and actual variables for induction manifold pressure P and air mass flow MF, and thereby acts upon both the model unit 18 and also an inverse model unit 20 provided in the reverse block 17. As a result, a control circuit is completed between alignment unit 19 and model unit 18 which compensates for deviations between modeled air mass flow mMF and actual air mass flow iMF by way of intervention in respect of the cross-section function Q and also the ambient air pressure LD, in other words the air pressure upstream of the throttle. The case is similar for the solution of the differential equation into which is then directly input the improved modeled mass flow mMF. To this end, the alignment model 19 uses the actual values for induction inlet pressure iP and air mass flow iMF supplied by the air mass flow sensor 10 and the pressure sensor 11.

In the reverse block 17, which has the inverse model unit 20, the model executed in the model unit 18 is now run in the opposite direction, whereby desired values for induction manifold pressure sP and air mass flow sMF are input in order to determine desired values for throttle setting D and valve lift V. The alignment parameters in respect of cross-section function Q or pressure upstream of the throttle are likewise taken into consideration in this situation. The value for the cross-section function Q is now determined by means of equation 1, whereby the desired value for the air mass flow sMF is now used instead of the modeled value. The desired throttle setting sD is determined from the value for the cross-section function Q by way of the characteristic line. The desired value for the valve lift setting sV is ascertained by analogy. These desired values are then set on the internal combustion engine 1.

Figure 3:
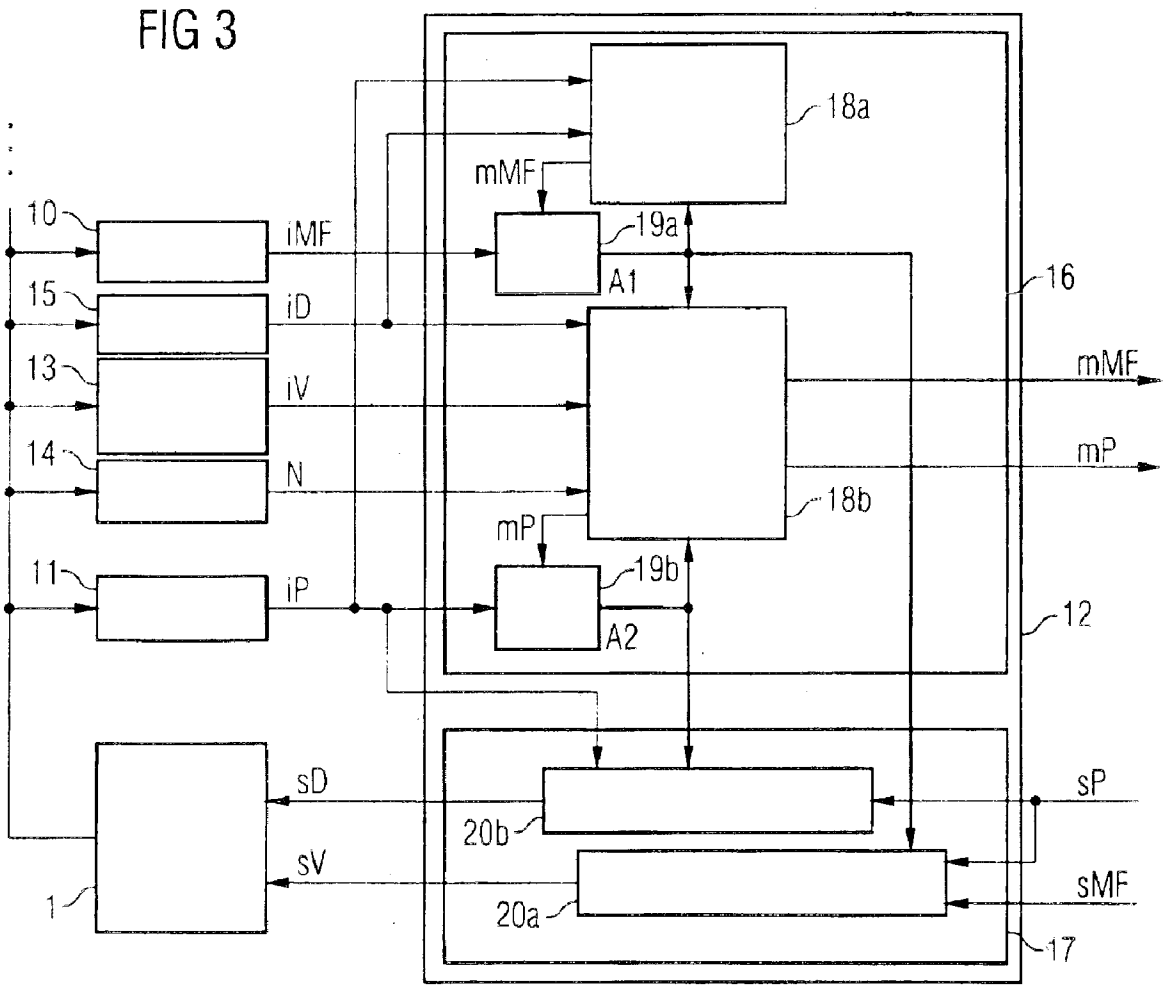
FIG. 3 shows a structure of a second embodiment of a method for regulating fuel injection.

FIG. 3 shows a somewhat modified variant of the block diagram illustrated in FIG. 2, in which the model unit 18 is split into sub-model units 18*a* and 18*b*. An independent alignment module 19*a*, 19*b* is provided for each respective sub-model unit. The inverse model unit is likewise subdivided into two sub-inverse model units 20*a* and 20*b*.

In this situation, the model unit 18*a* models the air mass flow MF and the model unit 18*b* models the induction manifold pressure P.

The inverse model unit 20*a* determines the desired value for the valve lift sV from the desired values for mass flow sMF and induction manifold pressure sP. The inverse model unit 20*b* accesses the desired value for the induction manifold pressure sP and determines the desired value for the throttle setting sD. In this situation, alignment parameters A1 and A2 which originate from the alignment modules 19*a*, 19*b* are fed to the inverse model units 20*a* and 20*b*.

Apart from the fact that they share input variables, namely actual values for induction manifold pressure iP and throttle setting iD, the model units 18*a* and 18*b* are coupled by the fact that the model unit 18*b* utilizes the alignment parameters A1 which the alignment module 19*a* ascertained for the model unit 18*a*. The model unit 18*a* calculates a modeled value for the mass flow from equation 1. This value mMF is compared with the actual value iMF and from this comparison is determined a correction factor for the value of the cross-section function Q. This correction factor represents the alignment parameter A1.

It is taken into consideration by the model unit 18*b* in equation 3 in which the air mass flow MF is input. For calculating the actual value, which is done by analogy with equation 1, the correction factor for the cross-section function Q is taken into consideration. As a result of numeric solution of the differential equation which results from the combination of equations 3 and 4, the model unit 18*b* delivers the modeled induction manifold pressure mP. As a result of a comparison between the modeled induction manifold pressure mP and the actual induction pressure iP, the alignment module 19*b* produces a correction factor for the valve lift function VH; this represents the alignment parameter A2.

The alignment parameters A1 and A2, in other words the correction factor for the cross-section function Q and the correction factor for the valve lift function VH, are then taken into consideration by the inverse model units 20*a* and 20*b* when in an inversion of equation 1 or of equation 3, 4 the latter calculate the desired values for throttle setting D and valve lift V from the desired values for induction manifold pressure P and air mass flow MF.

In order to promote the stability of the system, in this situation the alignment parameters A1 and A2 are additionally subjected to a lowpass filtering process. This is carried out in the embodiment by the model units 18*a* and 18*b* in order to render the control loop completed between the alignment modules 19*a*, 19*b* and the model units 18*a*, 18*b* more stable. This lowpass filtering also benefits the inverse model units 20*a* and 20*b* at the same time. Furthermore, a special control structure, a PI regulator for example, can also be incorporated into the control loop.

What is claimed is:

1. A method regulating the fuel injection of an internal combustion engine, to which combustion air is fed through an intake tract having first and second air flow control elements spaced apart with respect to each other along the length of the tract to provide for control of the air flow into the engine, said method comprising the steps of:

a) obtaining signals representative of the actual values of the position settings of the first and second air flow control elements and of engine rotational speed;

b) utilizing the signals representative of the actual values of the position settings of the first and second air flow control elements and of engine rotational speed as input variables to calculate model values for air induction pressure an air mass flow in the intake tract;

c) obtaining signals representative of the actual values of air induction pressure and air mass flow in the intake tract;

d) utilizing the model values calculated for air induction pressure and air mass flow and the actual values of air induction pressure and air mass flow to calculate alignment values compensating for deviations between the model air mass flow and the actual air mass flow;

e) supplying signals representative of values of a desired pressure and a desired mass air flow wanted in the intake tract; and f) utilizing the alignment values and desired values to calculate operating position setting values for the first and second control elements.

2. Method according to claim 1, in which the calculated alignment values and the desired values are together processed using calculations which are inverse to the calculations used to obtain the alignment values, whereby the operating position setting values for the first and second control elements are obtained.

3. Method according to claim 2, in which alignment values are saved and new values for alignment values are only stored if the internal combustion engine is within a certain operational parameter range.

4. Method according to claim 1, wherein the model value for the air mass flow is calculated from the measurement value for the induction manifold pressure and from the actual position of the first final control element, and the model value for the induction manifold pressure is calculated from the measurement value for the air mass flow and from the actual position of the second final control element, and wherein the model value for air mass flow nd induction pressure are calculated independently of each other.

5. Method according to claim 4, wherein the alignment value of the air mass flow s obtained before e calculation for induction manifold pressure is effected and the aligned value of the air mass flow is used in the calculations for the alignment value of the induction manifold pressure.

6. Method according to claim 1, in which a throttle valve is used as the first control element and a valve lift adjuster for a variable inlet valve lift drive is used as the second control element.

* * * * *